US010421114B2

(12) United States Patent
Hirata

(10) Patent No.: US 10,421,114 B2
(45) Date of Patent: Sep. 24, 2019

(54) WORKPIECE MANUFACTURING APPARATUS

(71) Applicant: TOYOTA BOSHOKU KABUSHIKI KAISHA, Aichi (JP)

(72) Inventor: Kazuyuki Hirata, Toyota (JP)

(73) Assignee: TOYOTA BOSHOKU KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/002,048

(22) Filed: Jun. 7, 2018

(65) Prior Publication Data

US 2018/0361608 A1 Dec. 20, 2018

(30) Foreign Application Priority Data

Jun. 20, 2017 (JP) ..... 2017-120489

(51) Int. Cl.

| | |
|---|---|
| ***B21D 45/04*** | (2006.01) |
| ***B26D 7/32*** | (2006.01) |
| ***B26D 7/18*** | (2006.01) |
| ***B21D 45/10*** | (2006.01) |
| ***B26F 1/40*** | (2006.01) |

(52) U.S. Cl.

CPC ..... *B21D 45/04* (2013.01); *B21D 45/10* (2013.01); *B26D 7/18* (2013.01); *B26D 7/32* (2013.01); *B26F 1/40* (2013.01); *Y10T 83/9423* (2015.04)

(58) Field of Classification Search

CPC . B26D 7/18; B26D 7/32; B21D 45/10; B21D 45/003; B21D 45/02; B21D 45/04; B26F 1/40; Y10T 83/9423; Y10T 83/9425; Y10T 83/9428; Y10T 83/2074; Y10T 83/2092; Y10T 83/2096; Y10T 83/2192

See application file for complete search history.

(56) References Cited

U.S. PATENT DOCUMENTS 2,314,120 A * 3/1943 Braun ..... B30B 15/32 425/436 RM
3,148,571 A * 9/1964 Wallis ..... B21D 43/105 100/207
3,653,293 A * 4/1972 Wallis ..... B21D 43/16 83/82

(Continued)

FOREIGN PATENT DOCUMENTS

JP 2005-254312 9/2005

*Primary Examiner* — Phong H Nguyen

(74) *Attorney, Agent, or Firm* — Greenblum & Bernstein, P.L.C.

(57) ABSTRACT

A workpiece manufacturing apparatus includes a lower die assembly, an upper die assembly, a workpiece extracting device, and a workpiece conveying device. The lower die assembly includes a punch configured to punch out a workpiece into the upper die assembly. The upper die assembly includes an ejector configured to eject the punched out workpiece. The extracting device includes a catch plate configured to receive the ejected workpiece and a moving mechanism, which moves the catch plate between positions below the upper die assembly and the conveying device. The moving mechanism is configured to move the catch plate from the conveying device to the positions below the upper die assembly as the upper die assembly moves upward and to move the catch plate from the positions below the upper die assembly to the conveying device as the upper die assembly moves downward.

3 Claims, 7 Drawing Sheets

(56) References Cited

U.S. PATENT DOCUMENTS

| | | | | |
|---|---|---|---|---|
| 4,809,576 | A * | 3/1989 | Bakermans | B21D 28/002 198/502.1 |
| 6,412,379 | B1 * | 7/2002 | Turusaki | B26D 7/18 83/155.1 |
| 2009/0301161 | A1 * | 12/2009 | Fujimura | B21D 45/003 72/328 |
| 2011/0079122 | A1 * | 4/2011 | Hirata | B21D 45/003 83/23 |
| 2017/0313015 | A1 * | 11/2017 | Kitamura | B29C 43/04 |

* cited by examiner

WORKPIECE MANUFACTURING APPARATUS

BACKGROUND OF THE INVENTION

The present disclosure relates to a workpiece manufacturing apparatus.

In a workpiece manufacturing apparatus, an unprocessed material is placed between the upper die assembly and the lower die assembly, then the upper die assembly is moved downwards and tightened against the lower die assembly, so that the punch provided in the lower die assembly punches a workpiece out from the material into the upper die assembly. Thereafter, the upper die assembly is moved upward away from the lower die assembly, and the workpiece is ejected downward from the upper die assembly by the ejector provided in the upper die assembly. Japanese Laid-Open Patent Publication No. 2005-254312 discloses an extracting device for such an ejected workpiece.

The extracting device has a shovel for receiving a workpiece ejected downward from the upper die assembly and a link mechanism for moving the shovel. The link mechanism moves the shovel to a position below the upper die assembly as the upper die assembly moves upward. At this time, the workpiece is ejected downward from the upper die assembly, and the workpiece is received by the shovel. The link mechanism moves the shovel away from the position below the upper die assembly as the upper die assembly moves downward. At this time, the shovel tilts so that the workpiece slides down from the shovel and is collected in a bucket.

SUMMARY OF THE INVENTION

In the above-described extracting device, when a workpiece slides in the shovel, it can collide with the inner wall of the shovel. The workpiece can also collide with other workpieces stored in the bucket when falling into the bucket. Therefore, when the workpiece to be manufactured has a shape of a thin plate, the workpiece may be deformed by the collisions described above.

Accordingly, it is an objective of the present invention to provide a workpiece manufacturing apparatus that limits deformation of a workpiece when extracting the workpiece ejected from the upper die assembly.

In accordance with one aspect of the present invention, a workpiece manufacturing apparatus is provided that includes a lower die assembly, an upper die assembly, which is movable vertically to approach and separate from the lower die assembly, a workpiece extracting device, and a workpiece conveying device. The lower die assembly includes a punch configured to punch out a rectangular plate-shaped workpiece into the upper die assembly from a plate-shaped unprocessed material held between the lower die assembly and the upper die assembly. The upper die assembly includes an ejector configured to eject the punched out workpiece downward from the upper die assembly. The extracting device includes a catch plate configured to receive opposite ends in a longitudinal direction of the workpiece ejected from the upper die assembly, and a moving mechanism, which moves the catch plate between a position below the upper die assembly and the conveying device. The moving mechanism is configured to move the catch plate from the conveying device to the position below the upper die assembly as the upper die assembly moves upward and to move the catch plate from the position below the upper die assembly to the conveying device as the upper die assembly moves downward.

Other aspects and advantages of the present invention will become apparent from the following description, taken in conjunction with the accompanying drawings, illustrating by way of example the principles of the invention.

DETAILED DESCRIPTION OF THE PREFERRED EMBODIMENTS

A workpiece manufacturing apparatus 1 according to one embodiment will now be described with reference to FIGS. 1 to 8.

Figure 1:
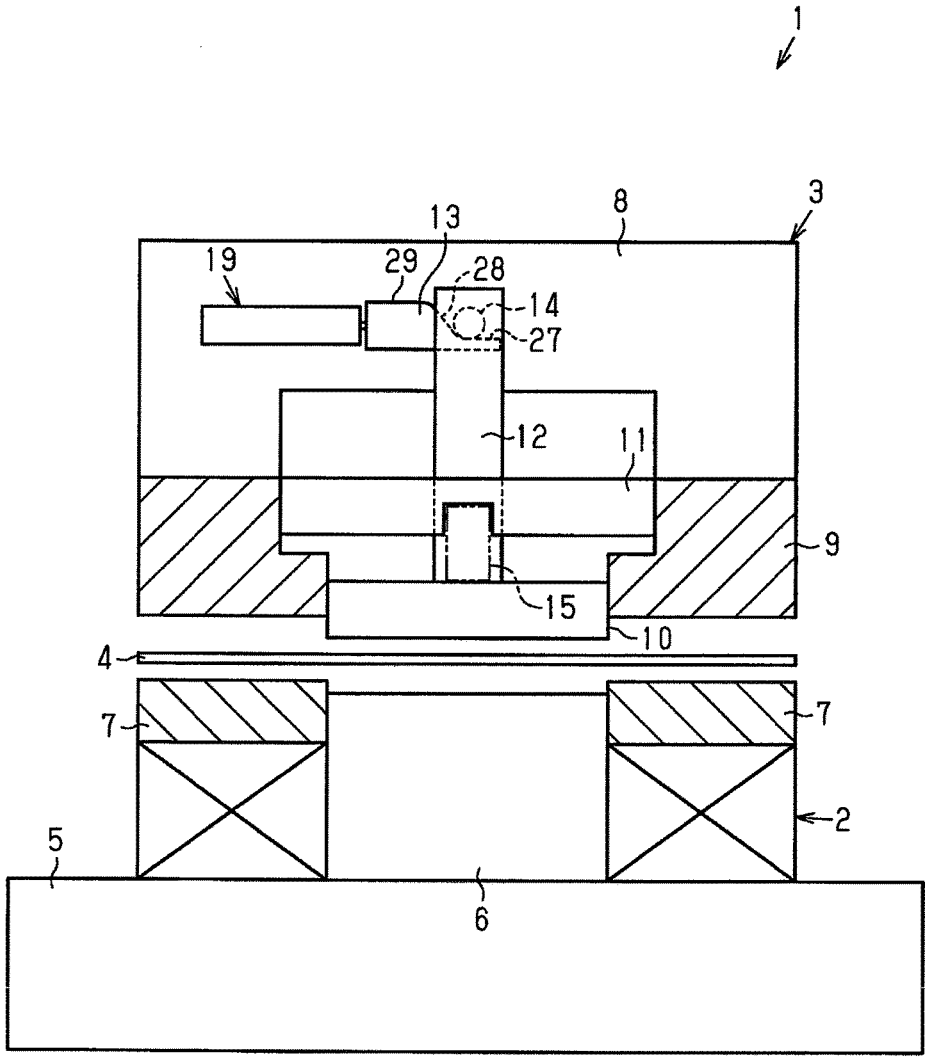
FIG. 1 is a schematic diagram of a workpiece manufacturing apparatus according to one embodiment.

The workpiece manufacturing apparatus 1 shown in FIG. 1 has a lower die assembly 2, which is a fixed die, and an upper die assembly 3, which is a movable die. The upper die assembly 3 is located above the lower die assembly 2 and approaches or separates from the lower die assembly 2 in the vertical direction. By placing an unprocessed material 4, for example, a metal plate between the lower die assembly 2 and the upper die assembly 3 and moving the upper die assembly 3 downward, the lower die assembly 2 and the upper die assembly 3 are clamped with the material 4 in between. Then, by moving the upper die assembly 3 upward from the clamped state, the lower die assembly 2 and the upper die assembly 3 are opened.

The lower die assembly 2 includes a lower table 5, which is fixed to the installation surface (not shown) of the workpiece manufacturing apparatus 1, a punch 6, which is fixed to the upper surface of the lower table 5 so as to protrude upward, and a stripper 7, which surrounds the punch 6 and is movable upward and downward with respect to the lower table 5. The upper end of the stripper 7 is positioned above the upper end of the punch 6 so that the material 4 can be placed on the upper end of the stripper 7 in the opened state of the manufacturing apparatus 1. With the lower die assembly 2 and the upper die assembly 3 clamped, the punch 6 is used to punch out a workpiece of a rectangular plate shape from the material 4. An example of the workpiece is a separator for use in a cell stack of a fuel cell.

The upper die assembly 3 has an upper table 8, which is moved vertically by a lifting device, a die 9, which is fixed to the lower surface of the upper table 8 to face the stripper 7 of the lower die assembly 2, and an ejector 10, which is provided in a part of the die 9 that corresponds to the punch 6 of the lower die assembly 2. The ejector 10 is configured to move vertically. The ejector 10 is a rectangular plate-shaped member corresponding to the workpiece, and approaches and separates from the lower die assembly 2 by moving vertically inside the die 9. The die 9 includes a fixed block 11 fixed thereto and positioned above the ejector 10. A support member 12 protrudes upward from the central portion of the ejector 10 and passes through the fixed block 11.

The upper table 8 is provided with a slider 13, which extends in a direction intersecting the support member 12 (the horizontal direction). The slider 13 supports the ejector 10 and the support member 12. More specifically, a roller 14 is rotationally attached to the upper end of the support member 12. The roller 14 moves integrally with the ejector 10 through the support member 12. An urging mechanism 15 including a spring is provided between the ejector 10 and the fixed block 11. The roller 14 remains in contact with the upper surface of the slider 13 by the vertical urging force of the spring of the urging mechanism 15 and the gravity acting on the ejector 10 and the support member 12. In this way, the ejector 10 and the support member 12 are supported by the slider 13 of the upper table 8 with the roller 14.

FIGS. 2 to 5 show the manufacturing process of a workpiece by the manufacturing apparatus 1.

Figure 2:
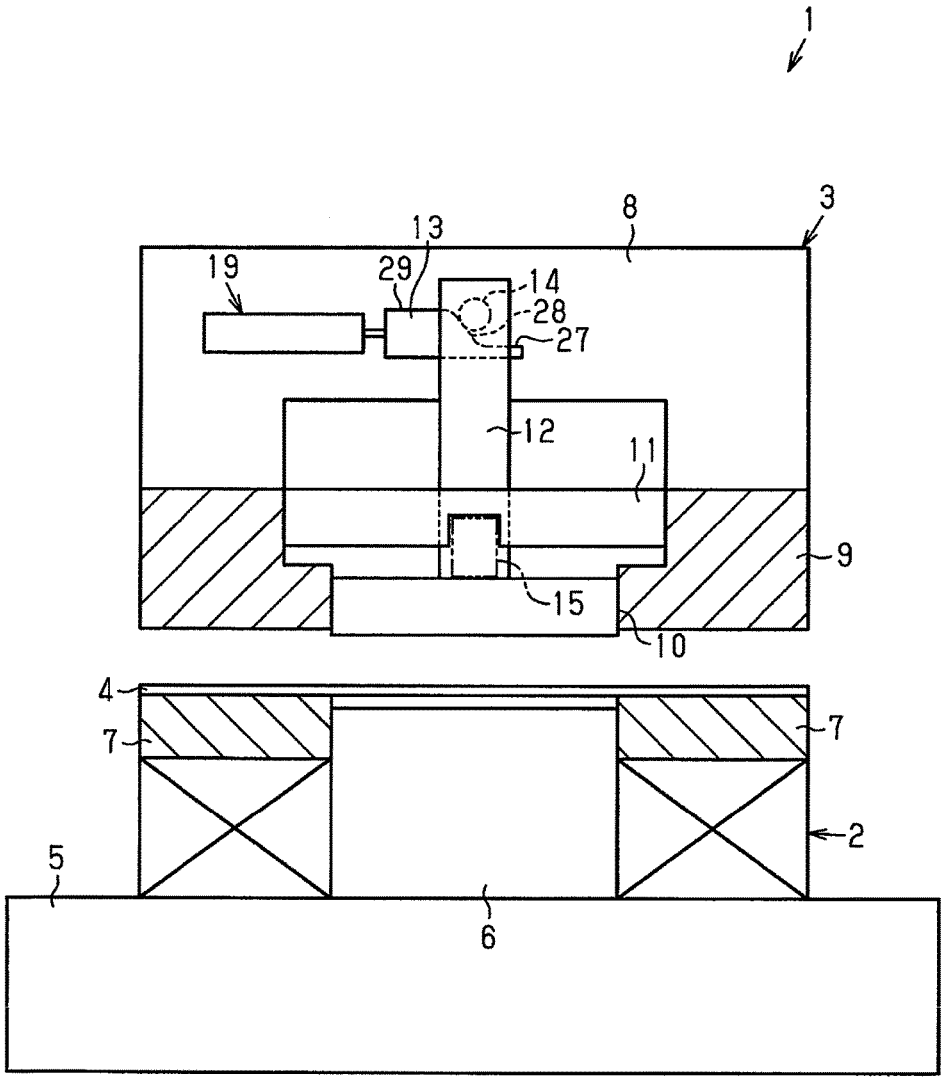
FIGS. 2 to 5 show the manufacturing process of a workpiece by the manufacturing apparatus of FIG. 1.
Figure 3:
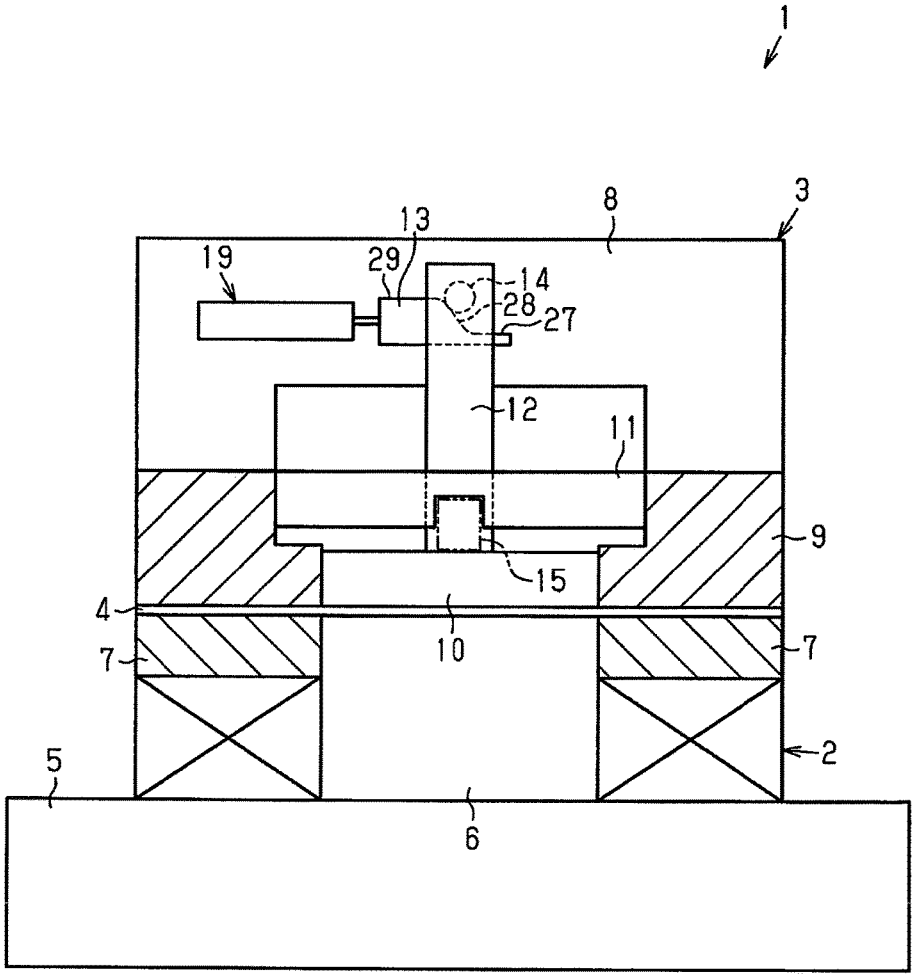
Figure 4:
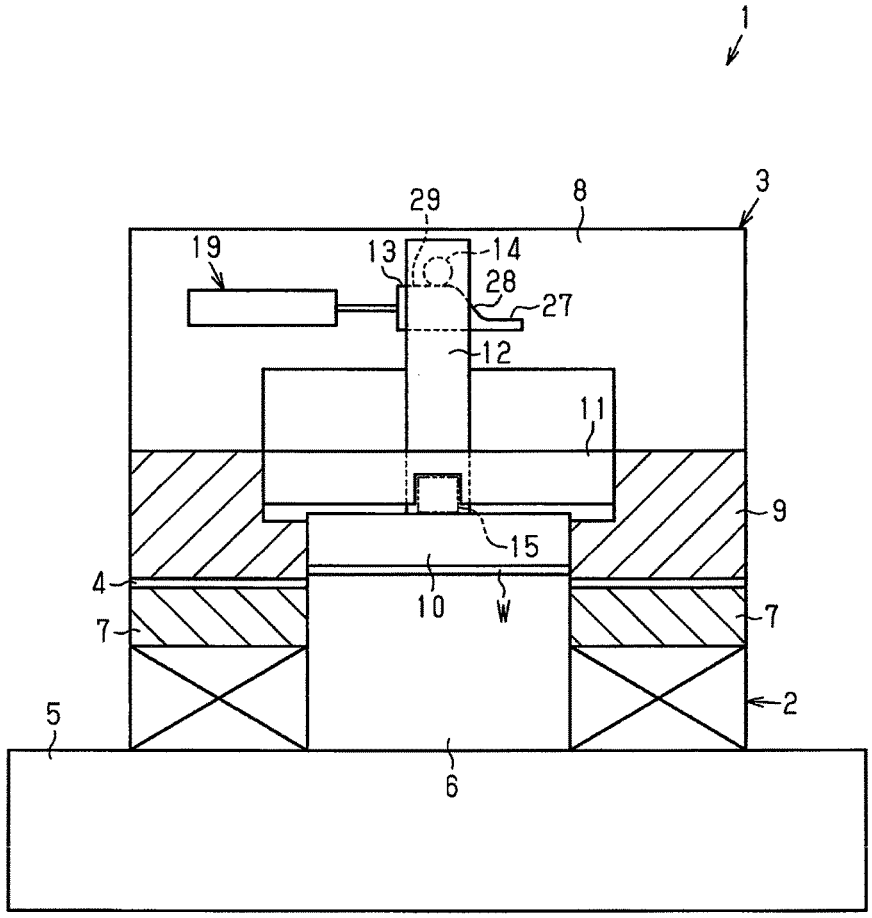

The material 4 is placed on the stripper 7 of the lower die assembly 2 as shown in FIG. 2. Then, as the upper die assembly 3 is moved downward, the die 9 of the upper die assembly 3 pushes down the material 4 and the stripper 7 while holding the material 4 between the die 9 and the stripper 7 as shown in FIG. 3. Through the pushing down of the material 4, the punch 6 of lower die assembly 2 punches out a workpiece W from the material 4 with the material 4 held between the punch 6 and the ejector 10 as shown in FIG. 4. At this time, the ejector 10 urges the material 4 toward the punch 6 with the urging force of the spring of the urging mechanism 15, so that the workpiece W is prevented from being deformed when being punched out from the material 4.

The workpiece W punched out by the punch 6 is fitted into the die 9 of the upper die assembly 3 and the ejector 10 is retracted into the die 9. The workpiece manufacturing apparatus 1 is provided with a locking device. The locking device locks the ejector 10 with respect to the upper die assembly 3 (the die 9) at the position where the punch 6 punches the workpiece W from the material 4 and releases the ejector 10 when the workpiece manufacturing apparatus 1 is opened. The locking device includes the slider 13, which is provided in the upper table 8 and movable in the horizontal direction, and an actuator 19, which is provided in the upper table 8 to slide the slider 13.

The upper surface of the slider 13 is divided into a releasing surface 27, a slope 28, and a locking surface 29 in this order from the side farthest from the actuator 19. The locking surface 29 is located at a higher level than the releasing surface 27, and the slope 28 is inclined with respect to the horizontal plane so as to connect the releasing surface 27 and the locking surface 29. When the slider 13 slides horizontally, the roller 14 contacting the upper surface of the slider 13 rolls along the releasing surface 27, the slope 28, and the locking surface 29.

As shown in FIG. 4, when the punch 6 punches out the workpiece W from the material 4 in the clamped state of the manufacturing apparatus 1, the ejector 10 is retracted into the die 9 against the urging force of the spring of the urging mechanism 15. This displaces the roller 14, which moves integrally with the ejector 10, upward. At this time, when the slider 13 is slid rightward as viewed in FIG. 4 by the actuator 19, the roller 14 comes into contact with the locking surface 29 of the slider 13. Under this condition, the locking surface 29 of the slider 13 pushes the roller 14 upward and compresses the spring of the urging mechanism 15 so that the ejector 10 is locked relative to the die 9 at a position where the punch 6 punched out the workpiece W from the material 4.

Figure 5:
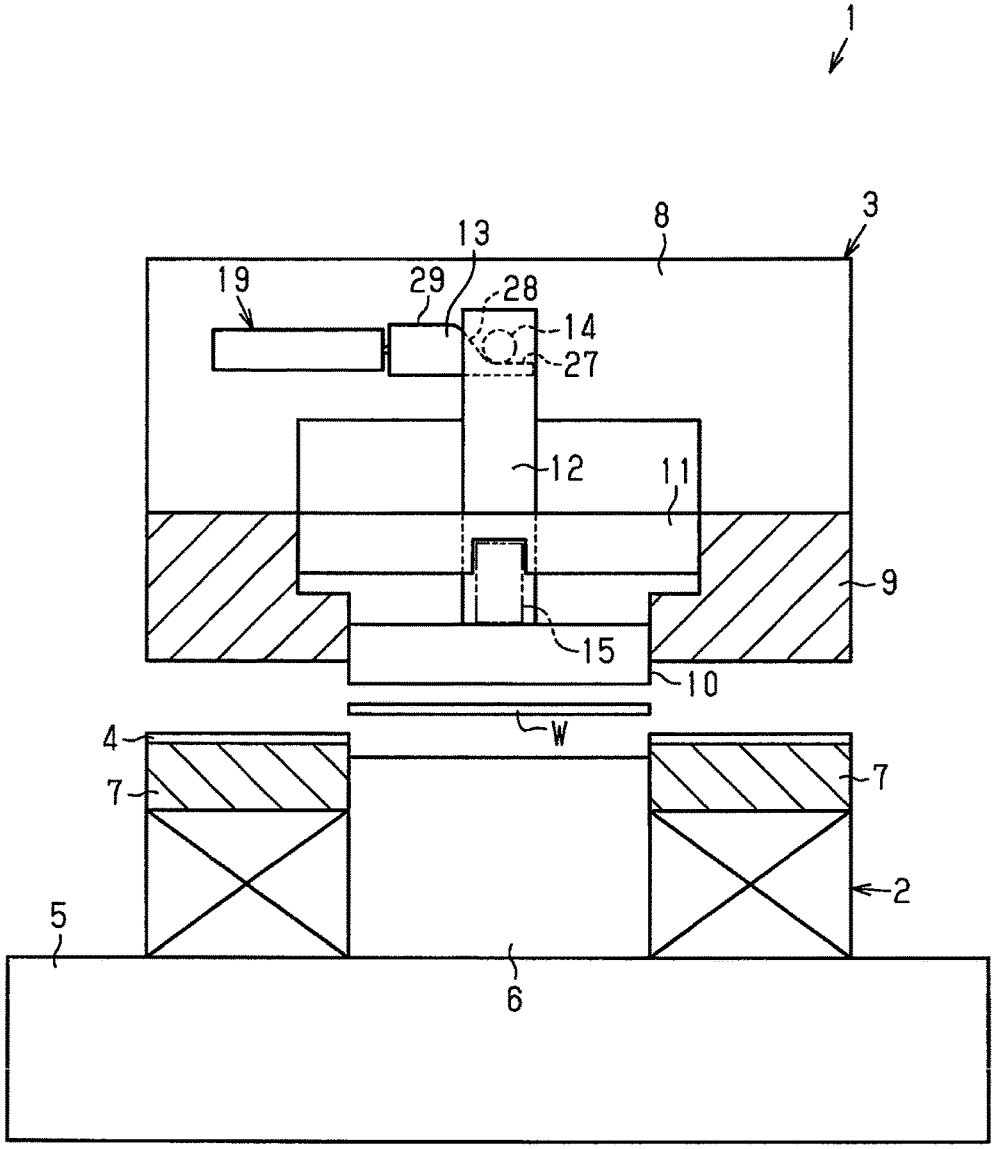

When the actuator 19 slides the slider 13 to the left in FIG. 4 with the slider 13 in the locking position and the lower die assembly 2 and the upper die assembly 3 in the opened state of the manufacturing apparatus 1, the roller 14 comes in contact with the slope 28 and the releasing surface 27 of the slider 13 in this order. When the roller 14 is in contact with the releasing surface 27, the urging force applied to the ejector 10 by the spring of the urging mechanism 15 is weakened as compared with that during compression, so that the ejector 10 is unlocked relative to the die 9. As a result, the ejector 10 is moved downward by the urging force of the spring of the urging mechanism 15 and the gravity acting on the ejector 10 and the support member 12 until the ejector 10 protrudes toward the lower die assembly 2 from the die 9 as shown in FIG. 5. Such downward movement of the ejector 10 ejects the workpiece W fitted in the die 9 from the die 9.

Next, an extracting device 31 for receiving and extracting the workpiece W ejected downward from the die 9 will be described.

Figure 6:
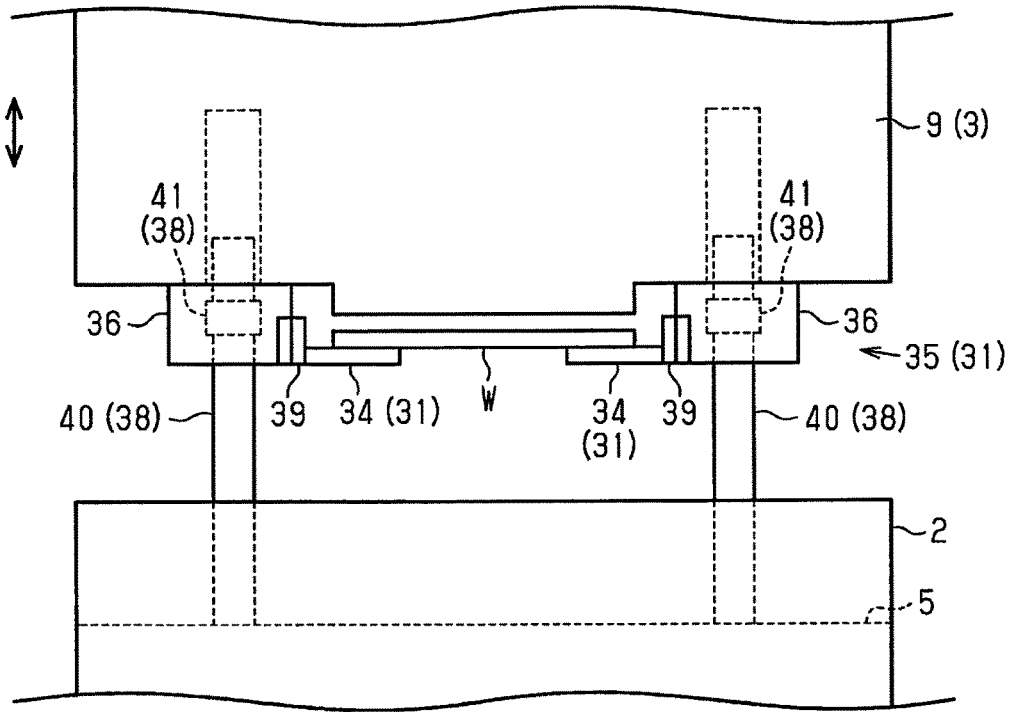
FIG. 6 is a front view of an extracting device provided in the workpiece manufacturing apparatus of FIG. 1.
Figure 7:
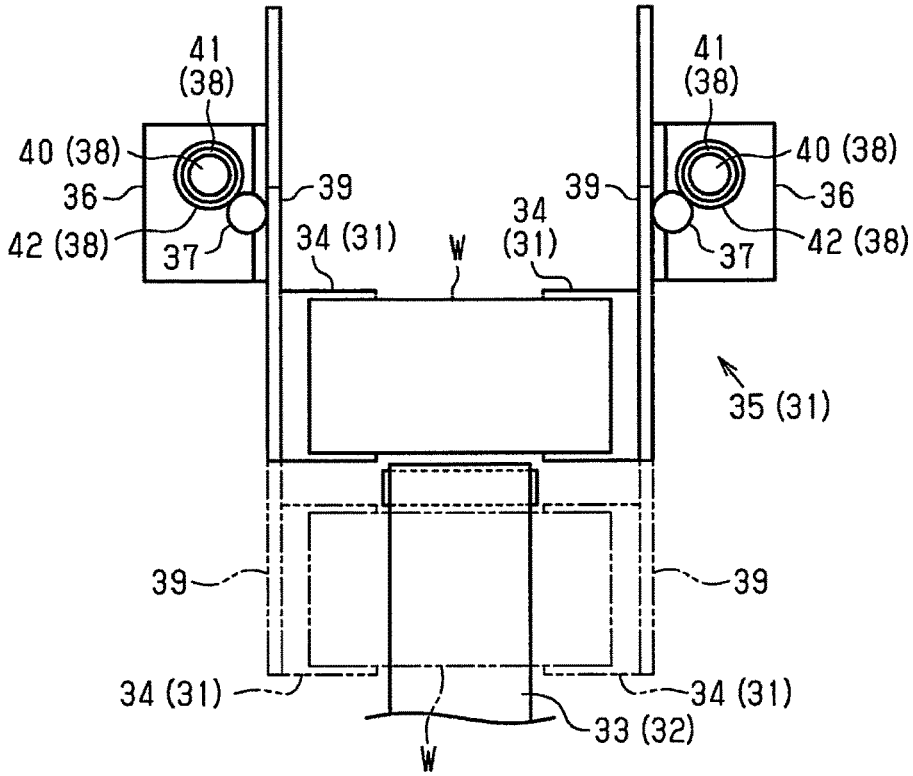
FIG. 7 is a plan view of the extracting device of FIG. 6.
Figure 8:
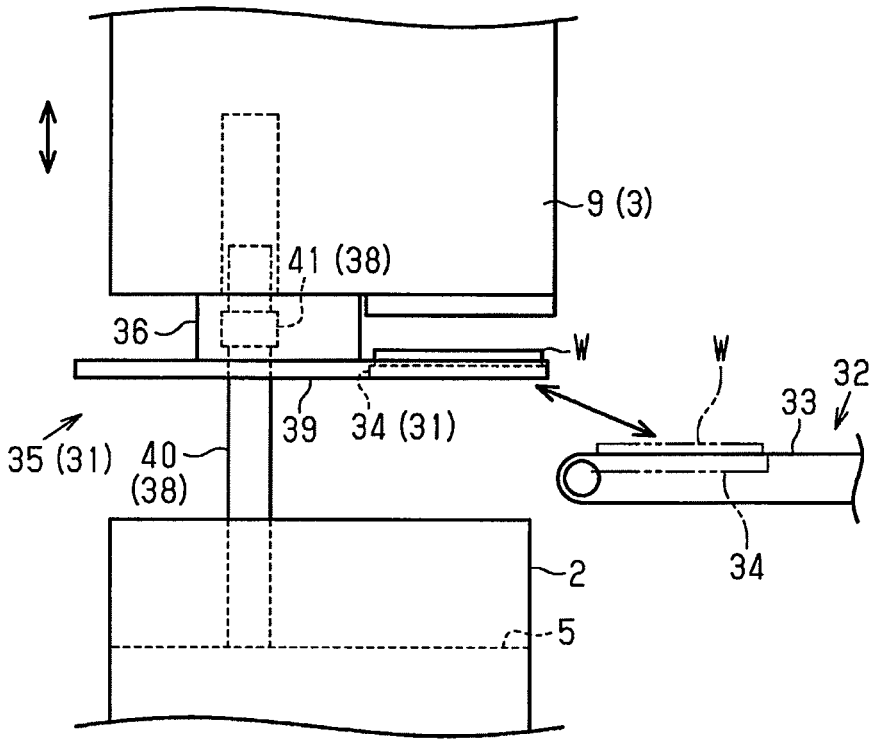
FIG. 8 is a side view showing an operating state of the extracting device of FIG. 6.

FIGS. 6 to 8 are respectively a front view of the extracting device 31 provided in the manufacturing apparatus 1, a plan view of the extracting device 31, and a side view showing an operating state of the extracting device 31. As shown in FIG. 8, the extracting device 31 receives the workpiece W ejected downward from the die 9 and transfers it to a conveying device 32. The conveying device 32 includes an endless belt 33. The workpiece W is placed on the belt 33 of the conveying device 32 by the extracting device 31 and conveyed horizontally away from the manufacturing apparatus 1.

The extracting device 31 includes a pair of catch plates 34, which receives the opposite ends in the longitudinal direction of the workpiece W (a direction orthogonal to the sheet of FIG. 8) ejected downward from the die 9, and a moving mechanism 35, which moves the catch plates 34 between a position below the die 9 and the conveying device 32 in accordance with the vertical movement of the upper die assembly 3. The moving mechanism 35 is configured such that, as the upper die assembly 3 moves upward, the moving mechanism 35 moves the catch plates 34 from the conveying device 32 to the position below the die 9, and that, as the upper die assembly 3 moves downward, the moving mechanism 35 moves the catch plates 34 from the position below the die 9 to the belt 33 of the conveying device 32. The moving mechanism 35 transfers the catch plates 34 between the position below the upper die assembly 3 and the conveying device 32 by displacing the catch plates 34 horizontally in conjunction with vertical movement of the upper die assembly 3.

As shown in FIG. 7, the moving mechanism 35 includes a pair of gear blocks 36, which is attached to the upper die assembly 3 (FIGS. 6 and 8) so as to be integrally movable with the upper die assembly 3, and a pair of pinions 37, which is supported by the gear blocks 36 so as to be rotational around center lines extending in the vertical direction (the direction orthogonal to the sheet of FIG. 7). Further, the moving mechanism 35 includes a pair of conversion mechanisms 38, which converts vertical motion of the gear blocks 36 into rotational motion of the pinions 37, and a pair of racks 39, which meshes with the pinions 37 and is displaced in the horizontal direction (the vertical direction as viewed in FIG. 7) based on rotation of the pinions 37. The catch plates 34 are attached to the rack 39 so as to move integrally with the rack 39.

The catch plates 34 are fixed to the respective racks 39 in the moving mechanism 35. The gear block 36, the conversion mechanism 38, the pinion 37, and the rack 39 that correspond to one of the catch plates 34 are arranged at one end in the longitudinal direction (the lateral direction as viewed in FIG. 7) of the workpiece W punched out into the die 9. The gear block 36, the conversion mechanism 38, the pinion 37, and the rack 39 that correspond to the other catch plate 34 are arranged at the other end in the longitudinal direction of the workpiece W. When approaching the conveying device 32 as the upper die assembly 3 moves downward, the catch plates 34 move to the opposite sides of the conveying device 32 in the horizontal direction (the lateral direction in FIG. 7).

The conversion mechanisms 38 each include a ball screw and a speed-change gear 42. The ball screw has a threaded shaft 40, which is fixed to the lower table 5 (FIG. 6) and extends vertically, and a nut 41, through which the threaded shaft 40 extends. The speed-change gear 42 is fixed to the nut 41 of the ball screw and meshes with the corresponding pinion 37 of the moving mechanism 35. When the gear blocks 36 (the upper die assembly 3) shown in FIG. 6 move vertically, the nuts 41 are each rotated about the threaded shaft 40 by the action of a large number of balls accommodated in the helical groove formed between the outer circumferential surface of the threaded shaft 40 and the inner circumferential surface of the nut 41. As a result, the pinions 37 meshing with the speed-change gears 42 (FIG. 7), which rotate integrally with the nuts 41, also rotate, and the rotation of the pinions 37 displaces the racks 39 and the catch plates 34 in the horizontal direction (the vertical direction as viewed in FIG. 7).

Since the rotation direction of the nuts 41 and the speed-change gears 42 is reversed between when the gear blocks 36 move upward and when the gear blocks 36 move downward, the rotation direction of the pinions 37 meshing with the speed-change gears 42 is also reversed. When the gear blocks 36 move upward, the pinions 37 rotate in a direction to move the racks 39 and the catch plates 34 from the conveying device 32 toward positions below the die 9 (FIG. 8). In contrast, when the gear blocks 36 move downward, the pinions 37 rotate in a direction to move the racks 39 and the catch plates 34 from the positions below the die 9 (FIG. 8) toward the conveying device 32.

The gear ratio between each speed-change gear 42 and the corresponding pinion 37, which mesh with each other, influences the rotation speed of the pinion 37 when the gear block 36 (the upper die assembly 3) moves in the vertical direction, and the rotational speed of the pinion 37 influences the moving speed of the catch plate 34 in the horizontal direction. The gear ratio is determined such that the moving speed of the catch plates 34 in the horizontal direction when the gear blocks 36 move downward corresponds to the conveying speed of the conveying device 32, that is, the rotation speed of the belt 33.

Next, an operation of the workpiece manufacturing apparatus 1 including the extracting device 31 will be described.

The manufacturing apparatus 1 manufactures workpieces by repeating the steps (A) to (C) shown below in this order.

(A) Dispose the material 4 between the lower die assembly 2 and the upper die assembly 3 in the opened state.

(B) Clamp the lower die assembly 2 and the upper die assembly 3 and punch out a workpiece W from the material 4 with the punch 6.

(C) While opening the lower die assembly 2 and the upper die assembly 3, eject the punched workpiece W from the die 9 with the ejector 10.

As the upper die assembly 3 moves upward from the state in which the lower die assembly 2 and the upper die assembly 3 are clamped, the catch plates 34 are moved from the conveying device 32 to positions below the die 9 (the positions indicated by the solid line in FIG. 8) by the moving mechanism 35.

With the catch plates 34 positioned below the die 9, the workpiece W is ejected downward from the die 9 by the ejector 10. The opposite ends in the longitudinal direction of the ejected workpiece W are supported by the catch plates 34 (FIG. 6). In other words, the catch plates 34 receive the workpiece W. Specifically, one of the opposite ends in the longitudinal direction of the workpiece W is supported by the catch plate 34 arranged at the position corresponding to that end, and the other end of the workpiece W is supported by the other catch plate 34 arranged at the position corresponding to the other end.

Thereafter, when the upper die assembly 3 (the die 9) moves downward from the state in which the lower die assembly 2 and the upper die assembly 3 are opened, the catch plates 34 are moved from the positions below the die 9 to the conveying device 32 by the moving mechanism 35.

Specifically, as the upper die assembly 3 moves downward, the catch plates 34 supporting the ends of the workpiece W are displaced horizontally toward the conveying device 32 by the gear blocks 36, the conversion mechanisms 38, the pinions 37, and the racks 39 of the moving mechanism 35 corresponding to the respective ends. At this time, the catch plates 34 descend while approaching the belt 33 of the conveying device 32 from above the conveying device 32 while supporting the workpiece W and move to the opposite sides in the horizontal direction of the conveying device 32 (the belt 33) as indicated by long dashed double-short dashed lines in FIGS. 7 and 8.

In this way, the catch plates 34 transfer the workpiece W to the conveying device 32, more specifically, place the workpiece W on the belt 33. The moving speed in the horizontal direction of the catch plates 34 when placing workpiece W on the belt 33 corresponds to the conveying speed of the conveying device 32, that is, the moving speed in the horizontal direction of the belt 33 (for example, equal to the moving speed in the horizontal direction of the belt 33). The workpiece W placed on the belt 33 is conveyed away from the manufacturing apparatus 1 (downward as viewed in FIG. 7, rightward as viewed in FIG. 8) by the movement of the belt 33 of the conveying device 32.

The above-described embodiment has the following advantages.

(1) The workpiece W ejected downward from the die 9 in the opened state of the manufacturing apparatus 1 is supported by the catch plates 34 of the extracting device 31 at the opposite ends in the longitudinal direction. After receiving the workpiece W, the catch plates 34 move from the positions below the die 9 to the conveying device 32 as the upper die assembly 3 moves downward and transfers the workpiece W to the conveying device 32. Since the workpiece W is moved and transferred to the conveying device 32 while being supported at the opposite ends in the longitudinal direction by the catch plates 34, deformation due to collision of the workpiece W with another object in the process is limited.

(2) As the upper die assembly 3 moves upward from the clamped state, the catch plates 34 move from the conveying device 32 to the positions below the die 9. Thereafter, as the upper die assembly 3 moves downward, the catch plates 34 move from the positions below the die 9 to the conveying device 32. At this time, since the catch plates 34 move downward while approaching the conveying device 32 from above the conveying device 32, it is easy to place the workpiece W supported by the catch plates 34 on the belt 33 of the conveying device 32. Therefore, the workpiece W is easily transferred from the catch plates 34 to the conveying device 32 and conveyed.

(3) One of the opposite ends in the longitudinal direction of the workpiece W ejected downward from the die 9 is supported by a catch plate 34 arranged at the position corresponding to that end, and the other end of the workpiece W is supported by the other catch plate 34 arranged at the position corresponding to the other end. As the upper die assembly 3 moves downward, the catch plates 34 supporting the ends of the workpiece W are displaced horizontally toward the conveying device 32 by the gear blocks 36, the conversion mechanisms 38, the pinions 37, and the racks 39 corresponding to the respective ends. The two catch plates 34 supporting the workpiece W move to the opposite sides in the horizontal direction of the conveying device 32 when approaching the conveying device 32. This allows the workpiece W to be easily placed on the belt 33 of the conveying device 32.

(4) When the upper die assembly 3 moves downward, the moving speed in the horizontal direction of the catch plates 34 supporting the workpiece W corresponds to the conveying speed of the conveying device 32 (the moving speed of the belt 33). Therefore, when the workpiece W supported on the catch plates 34 is placed on the belt 33 of the conveying device 32, the impact due to the difference between the moving speed of the workpiece W (the catch plates 34) and the moving speed of the belt 33 is limited.

The above-described embodiment may be modified as follows.

The moving speed in the horizontal direction of the catch plates 34 does not need to be equalized with the conveying speed of the conveying device 32 (the moving speed of the belt 33).

In the above-illustrated embodiment, the extracting device 31 is constituted by the two catch plates 34, which support the opposite ends in the longitudinal direction of the workpiece W, and the moving mechanism 35. The moving mechanism 35 moves the catch plates 34 and includes the gear blocks 36, the conversion mechanisms 38, the pinions 37, and the racks 39, which are provided at the positions corresponding to the opposite ends in the longitudinal direction of the workpiece W. The extracting device 31 is not limited to this configuration.

In the conversion mechanism 38, the vertical motion of the gear block 36 may be converted into rotational motion of the pinion 37 using a mechanism other than a ball screw.

The moving mechanism 35 may include a servomotor to rotate the pinion 37 based on a signal from a sensor that detects the vertical position of the upper die assembly 3, thereby moving the catch plates 34 between the conveying device 32 and the positions below the upper die assembly 3. In this case, the moving mechanism 35 also moves the catch plates 34 from the conveying device 32 to the positions below the upper die assembly 3 as the upper die assembly 3 moves upward. In addition, the moving mechanism 35 moves the catch plates 34 from the positions below the upper die assembly 3 to the conveying device 32 as the upper die assembly 3 moves downward. The moving mechanism 35 of this configuration does not require the conversion mechanisms 38.

Therefore, the present examples and embodiments are to be considered as illustrative and not restrictive and the invention is not to be limited to the details given herein, but may be modified within the scope and equivalence of the appended claims.

The invention claimed is:

1. A workpiece manufacturing apparatus comprising:

a lower die assembly;

an upper die assembly, which is movable vertically to approach and separate from the lower die assembly;

a workpiece extracting device; and a workpiece conveying device, wherein the lower die assembly includes a punch configured to punch out a rectangular plate-shaped workpiece into the upper die assembly from a plate-shaped unprocessed material held between the lower die assembly and the upper die assembly, the upper die assembly includes an ejector configured to eject the punched out workpiece downward from the upper die assembly, the extracting device includes a catch plate configured to receive opposite ends in a longitudinal direction of the workpiece ejected from the upper die assembly, and a moving mechanism, which moves the catch plate between a position below the upper die assembly and the conveying device by displacing the catch plate horizontally in conjunction with vertical movement of the upper die assembly, the moving mechanism including a gear block, which is attached to the upper die assembly to be movable integrally with the upper die assembly, a pinion, which is supported by the gear block so as to be rotational around a center line extending in a vertical direction, a conversion mechanism, which converts vertical motion of the gear block into rotational motion of the pinion, and a rack, which meshes with the pinion and moves horizontally based on rotation of the pinion, the catch plate is attached to the rack of the moving mechanism so as to be moved integrally with the rack, and the moving mechanism is configured to move the catch plate from the conveying device to the position below the upper die assembly as the upper die assembly moves upward and to move the catch plate from the position below the upper die assembly to the conveying device as the upper die assembly moves downward.

2. The workpiece manufacturing apparatus according to claim 1, wherein the catch plate is one of a pair of catch plates, the gear block, the conversion mechanism, the pinion, and the rack are included in one of two separate sets each corresponding to one of the catch plates, each catch plate is fixed to one of the separate racks in the moving mechanism, the gear block, the conversion mechanism, the pinion, and the rack that correspond to one of the catch plates are arranged at a position that corresponds to one end in the longitudinal direction of the workpiece punched out into the upper die assembly, the gear block, the conversion mechanism, the pinion, and the rack that correspond to the other catch plate are arranged at a position that corresponds to the other end in the longitudinal direction of the workpiece punched out into the upper die assembly, and the catch plates move to positions on opposite sides in a horizontal direction of the conveying device when approaching to the conveying device as the upper die assembly moves downward.

3. The workpiece manufacturing apparatus according to claim 2, wherein a rotation speed of the pinions when the upper die assembly moves downward is set such that a moving speed of the catch plates in the horizontal direction corresponds to a conveying speed of the conveying device.

* * * * *